US007305769B2

(12) United States Patent
McHenry et al.

(10) Patent No.: US 7,305,769 B2
(45) Date of Patent: Dec. 11, 2007

(54) AUTOMATIC OPENING AND CLOSING KNIFE

(75) Inventors: William McHenry, Wyoming, RI (US); Steven Ingram, Portland, OR (US)

(73) Assignee: Mentor Group, LLC, Oregon City, OR (US)

( * ) Notice: Subject to any disclaimer, the term of this patent is extended or adjusted under 35 U.S.C. 154(b) by 71 days.

(21) Appl. No.: 11/341,008

(22) Filed: Jan. 27, 2006

(65) Prior Publication Data

US 2007/0175045 A1 Aug. 2, 2007

(51) Int. Cl.
*B26B 1/08* (2006.01)

(52) U.S. Cl. ..... 30/162; 30/163

(58) Field of Classification Search ..... 30/151, 30/162, 163, 164, 329, 335, 336; 606/167, 606/182

See application file for complete search history.

(56) References Cited

U.S. PATENT DOCUMENTS

| | | | | | |
|---|---|---|---|---|---|
| 174,417 | A * | 3/1876 | Evans | ..... | 30/162 |
| 472,104 | A * | 4/1892 | Von Bultzingslowen | ..... | 30/163 |
| 475,306 | A * | 5/1892 | Franklin | ..... | 30/163 |
| 515,743 | A * | 3/1894 | Von Bultzingslowen | ..... | 30/163 |
| 845,792 | A * | 3/1907 | Jenkins | ..... | 30/162 |
| 1,024,749 | A * | 4/1912 | Sjoberg | ..... | 30/163 |
| 1,453,897 | A * | 5/1923 | Franz | ..... | 30/163 |
| 1,859,158 | A * | 5/1932 | Pernek, Sr. | ..... | 30/163 |
| 2,260,141 | A * | 10/1941 | Hanle | ..... | 30/163 |
| 4,265,017 | A * | 5/1981 | Collins | ..... | 30/162 |
| 4,926,555 | A * | 5/1990 | Lemaire | ..... | 30/162 |
| 5,371,948 | A * | 12/1994 | Liffiton | ..... | 30/163 |
| 2006/0207102 | A1 * | 9/2006 | Bezold et al. | ..... | 30/162 |

OTHER PUBLICATIONS

A series of 10 photographs of an OTF knife, assembled and disassembled, knife circa 2000.

* cited by examiner

*Primary Examiner*—Hwei-Siu C. Payer
(74) *Attorney, Agent, or Firm*—Hancock Hughey LLP

(57) ABSTRACT

An out-the-front automatic knife incorporates dual locking and release mechanisms that define a three-point blade-handle interconnection between the blade and the handle when the blade is locked in the open position. A single trigger is operable to automatically open the knife, and to automatically close the knife. Separate firing and retraction springs may be provided with different spring strength to vary the speed and strength of the blade moving to the open position, and to the closed position. Blade guide systems cause the blade to travel longitudinally and linearly. The handle substantially encloses the blade and incorporates an access port to facilitate cleaning and maintenance of components housed in the handle interior.

19 Claims, 8 Drawing Sheets

AUTOMATIC OPENING AND CLOSING KNIFE

FIELD OF THE INVENTION

This invention relates to knives equipped with blades that open automatically, and more particularly to "out-the-front" knives in which the blades open and close by sliding longitudinally into and out of the front of the handle.

BACKGROUND

There are numerous different designs for knives that have blades that slide longitudinally in the handle into the open position and back into the closed position. These so-called "out-the-front" knives, referred to herein as "OTF" knives, are sometimes mistakenly referred to as "Stiletto" type knives. However, the word "Stiletto" more accurately refers to a type of blade that has dual sharpened edges; Stiletto blades are commonly used in OTF knives.

OTF knives are inherently weaker than folding knives when the blades are in the open or extended position. The primary reason is that folding knives almost always have at least two very strong points of connection or interaction between the blade and the handle. The first point of connection is the highly secure connection between. the handle and the blade at the blade pivot point. The second point of connection is between the tang of the blade and a blade stop pin in the handle that contacts the tang of the blade and stops the blade's rotation when the blade is rotated into the open position. These two strong connections between the handle and the blade result in folding knives that have very strong blade-to-handle connections. What's more, many folding knives add a third strong point of connection between the blade and the handle: a lock that secures the blade in the open position and which must be disengaged to move the blade into the closed or folded position. It will be appreciated therefore that regardless of whether a folding knife has two or three of these connection points or "lands", the blade is very securely attached to the handle. The result is that the blade is very securely held in the open position with a minimal amount of blade wobble relative to the handle.

An OTF knife completely lacks the primary stabilizing feature of folding knives: the pivot axis. Indeed, in almost all OTF knives the blade travels freely in the handle at least at some point during both the opening and closing motions. As a result, OTF knives are notoriously weak and the blades are very prone to wobble when the blade is in the open position. Although OTF knives include locks to secure the blade in the open position, the locks tend to provide relatively little support for the blade. Typically, there are only one and at most two points of interconnection or lands between the handle and the blade. The result is that most OTF knives are little more than novelties, ill suited for tactical operations and serious work that requires a strong knife.

OTF knives generally use a spring-loaded mechanism to drive the blade from the closed to the open position. There are two basic spring mechanisms used in OTF knives. The first is sometimes called a "shuttle" system. These systems use a trigger to load the spring force that is applied to the blade. The second common system is uses a "mechanical" reload system that is similar in design to a crossbow. With these systems, the user manually loads the spring and that load is transferred to the blade when a trigger is activated. Typically, the trigger mechanism in an OTF is located to one side or the other of the spring mechanism. As a result, when the blade is driven into the open position it actually travels through a serpentine path. This causes unwanted wear on parts, including the sharpened edges of the blade.

With many OTF designs, the mechanism that locks the blade open not only is inherently weak as noted above, but also fails to correctly lock the blade in the open position, resulting in a misfire. When an OTF misfires, the blade is driven toward the open position but fails to lock, resulting in a dangerous situation. A misfire may also occur in the retracting direction with OTF knives that automatically retract the blade. A misfire when retracting the blade can obviously present a dangerous situation.

The present invention relates to an OTF knife that provides three points of interconnection between the handle and the blade when the blade is in the open position, resulting in an extremely strong blade/handle connection. The blade is driven to the open position with a firing spring. A separate retraction spring provides spring tension on the blade to automatically drive it from the open position into the stowed position in the handle. Latching and firing mechanisms interact with a trigger to lock and unlock the blade in both the open and closed positions. The latch mechanism includes a timing function to correctly time when the blade opens and closes.

The OTF knife of the present invention provides an extremely strong interconnection between the handle and the blade, and the latching and firing mechanisms prevent misfires.

BRIEF DESCRIPTION OF THE DRAWINGS

The invention will be better understood and its numerous objects and advantages will be apparent by reference to the following detailed description of the invention when taken in conjunction with the following drawings.

In FIG. 1 the blade is shown in dashed lines.

FIG. 7 is a plan view of the OTF knife according to the present invention exposing the carriage and springs. In FIG. 7 the blade is in the closed position and locked position.

FIG. 8 is a plan view similar to FIG. 7 except the firing trigger is being moved toward the firing position, loading the firing spring so the blade is ready to be fired.

FIG. 9 is a plan view as shown in FIG. 7 with the blade locked in the open position.

FIG. 10 is a plan view as shown in FIG. 7 except the firing trigger is being moved toward the retract position, loading the retraction spring so the blade is ready to be closed.

FIG. 11 is a plan view of the OTF knife according to the present invention with the lower handle half removed to expose the opening and latching mechanisms. In FIG. 11 the blade is in the locked and closed position.

In FIG. 12 the trigger mechanism is being moved into the firing position and, loading the firing spring in order to drive the blade into'the open position.

FIG. 13 is a plan view illustrating the firing and latching mechanisms when the blade is in the open and locked position.

FIG. 14 illustrates the latching and firing mechanisms of the knife when the firing trigger is being moved into the retract position, loading the retraction spring in order to ready the blade to be driven into the closed and locked position.

DETAILED DESCRIPTION OF THE PREFERRED EMBODIMENTS

Figure 1:
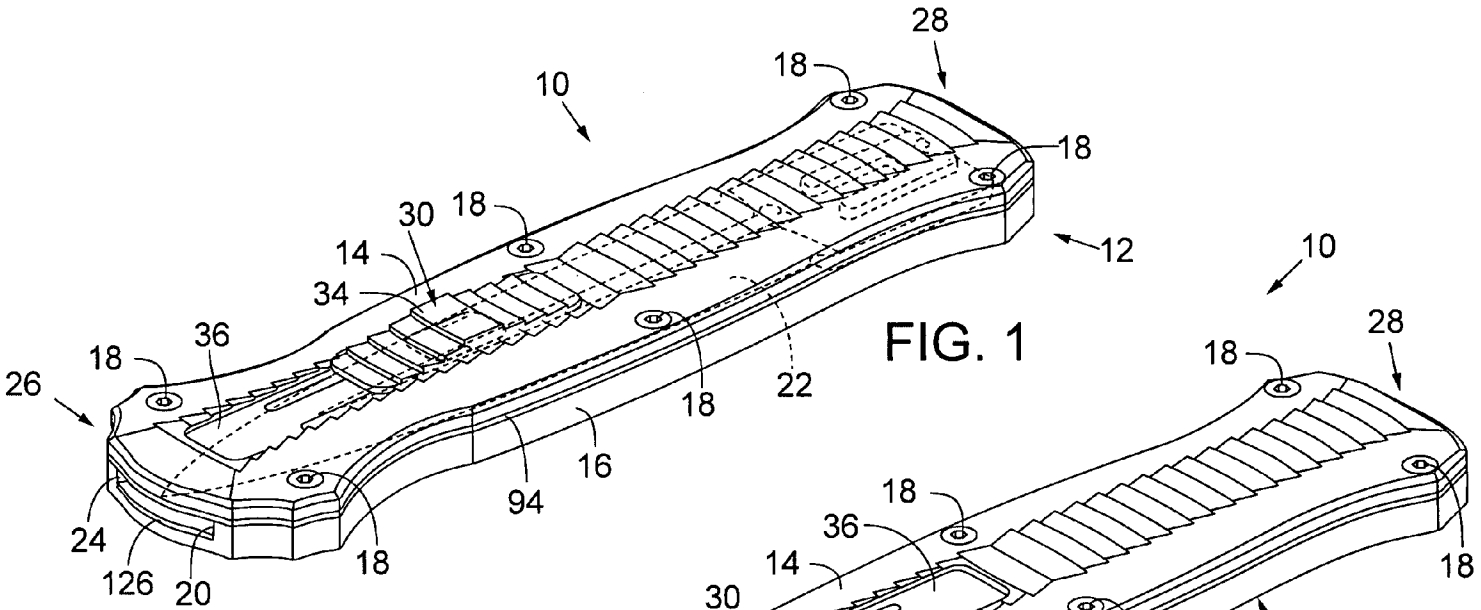
FIG. 1 is a perspective view of an OTF knife according to an illustrated embodiment of the present invention showing the blade in the closed or stowed position.

A preferred embodiment of an OTF knife 10 in accordance with the illustrated invention is shown in FIGS. 1 through 18. The primary structural components of knife 10 include a handle 12 that comprises a top or upper handle half 14 and a bottom or lower handle half 16. The handle halves 14 and 16 are mated together and held in place against one another with screws 18 positioned around the periphery of the handle. Screws 18 extend through openings 38 (see FIG. 6) in top handle half 14 and thread into threaded sleeves 19 retained in the interior of handle 12 in the assembled knife 10. Likewise; a second set of screws 18 extend through openings 38 in bottom handle half 16 and thread into the opposite ends of the threaded sleeves 19. Although not shown in the Figures for the purposes of clarity, the outer surface of bottom handle half 16 includes gripping ridges and decorative facets, and a clip may optionally be installed.

Figure 2:
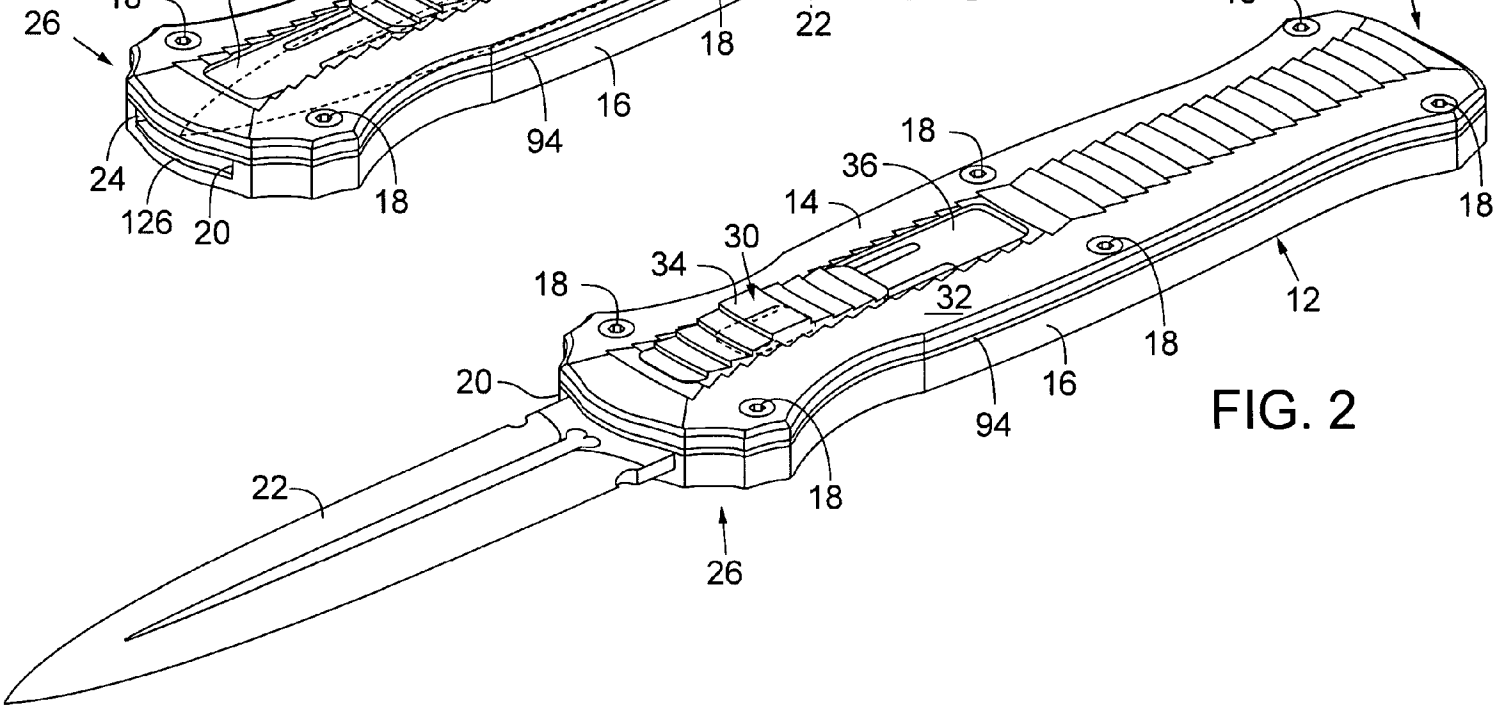
FIG. 2 is a perspective view of the knife shown in FIG. 1, illustrating the blade in the extended or open position.

When assembled together as shown in FIGS. 1 and 2, the two handle halves define a blade-receiving cavity 20 that receives blade 22. Blade 22 is movable longitudinally in handle 12 between the closed position of FIG. 1 and the open position of FIG. 2. Bottom handle half 16 includes a notch 24 at the forward or front end 26 of the handle 12 that defines an opening into the blade-receiving cavity 20. The end of handle 12 longitudinally opposite front end 26 is referred to as rearward or back end 28. A trigger mechanism shown generally at 30 in FIGS. 1 and 2 is located in the upper surface 32 of top handle half 14. The structure and operation of trigger mechanism 30 and its various components is detailed below, although in FIGS. 1 and 2 the thumb lug 34 is visible. Thumb lug 34 acts as the firing trigger. With reference to FIG. 1, the blade 22 is shown in the closed position and thumb lug 34 is positioned at the rearward end of an elongate groove 36 formed in upper surface 32. When blade 22 is in the open position as seen in FIG. 2, thumb lug 34 is slid in groove 36 toward the forward end of the groove. Relative directional terms used herein are based upon the "forward" end 26 of handle 12, and rearward end 28. Likewise, "upper" or "top" refers to the direction toward top handle halve 14 that houses the trigger mechanism and "lower" or "bottom" refers to the direction toward bottom handle half 16.

Figure 3:
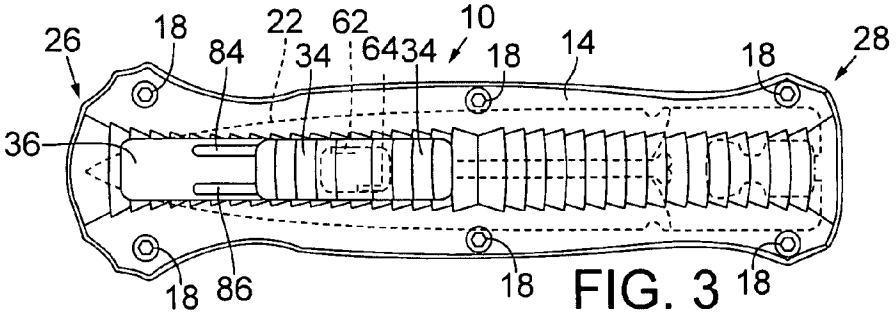
FIG. 3 is a top plan view of the knife illustrated in FIG. 1.
Figure 4:
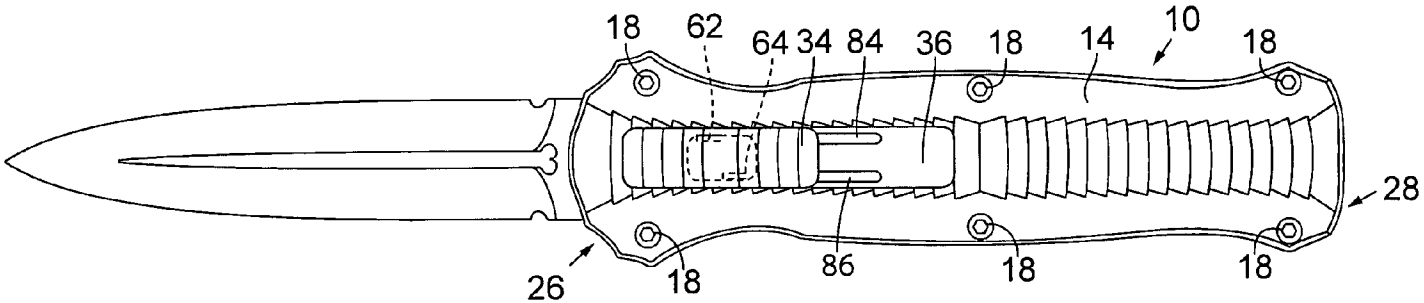
FIG. 4 is a top plan view of the knife illustrated in FIG. 2.

FIGS. 3 and 4 are top plan views of the knife 10 illustrated in FIGS. 1 and 2, respectively, and show the position of thumb lug 34 of trigger mechanism 30 in groove 36 when the blade 22 is in the closed position (FIG. 3) and the open position (FIG. 4).

Figure 5:
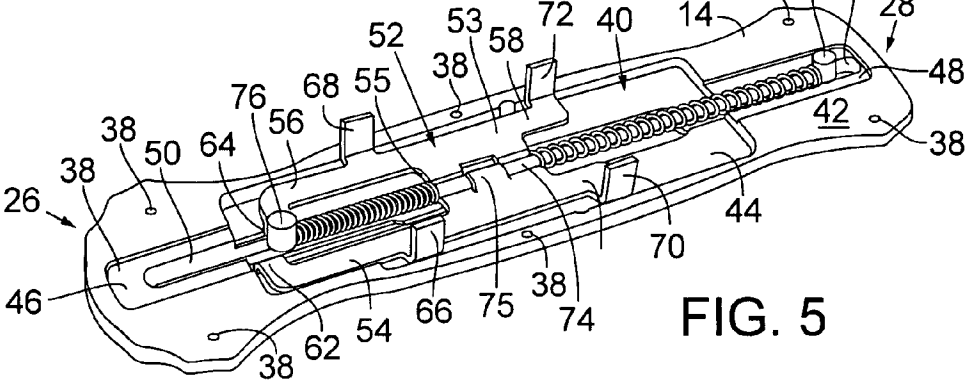
FIG. 5 is a perspective view of the upper handle half of an OTF knife according to the present invention, illustrating the internal carriage mechanism.

Turning now to FIG. 5, the interior side of upper handle half 14 is shown. Openings 38 are labeled in this figure; as noted above, screws 18 extend through openings 38 in both handle halves and thread into opposite sides of sleeves 19 to connect the two handle halves together. A cavity referenced generally with number 40 is formed in the inner surface 42 of handle half 14. Cavity 40 includes a relatively broader central portion 44, a relatively narrower front extension 46 and rear extension 48. A longitudinally central trough 50 extends from the forward portion of front extension 46, through central portion 44, and toward the rearward extent of rear extension 48. Cavity 40 is formed into handle half 14 in an appropriate manner according to the material used to fabricate the handle half. For example, if the handle is metallic or a similar hardened material, the cavity is milled into surface 42. If the handle is a molded material, the mold will include the cavity.

The relatively broader central portion 44 of cavity 40 is configured to slidably receive a carriage assembly 52, which as detailed below is part of the blade activation mechanisms and interconnects between the trigger mechanism 30 and the components of the latching and firing mechanisms. Carriage assembly 52 includes a generally H shaped main body 53 that has two opposed forwardly extending legs 54, 56, and two opposed rearwardly extending legs 58, 60. Leg 54 is slightly longer than opposite leg 56, and legs 58 and 60 are of equal length. A tab 62 is formed on the forward end of leg 54, where leg 54 is bent at about a 90° angle relative to the remainder of the leg. A similar tab 64 is formed on the forward end of leg 56. The tabs 62 and 64 provide a direct connection between thumb lug 34 and carriage 52.

Four additional tabs, labeled 66, 68, 70 and 72 are provided on carriage assembly 52 and extend in the opposite direction from tabs 62 and 64. The function of tabs 66 through 72 is detailed below.

A spring rod 74 is slidably attached to main body 53 such that the spring rod is received in trough 50. Thus, main body 53 includes a semi-circular depression 55 that receives the cylindrical spring rod 74. A tab 75 in the central portion of the main body 53 partially encircles spring rod 74 to retain main body connected to the spring rod, yet allows the spring rod to slide longitudinally in trough 50 relative to the carriage main body 53. Spring rod 74 also is slidable relative to main body 53. A forward keeper or catch 76 is provided on the forward end of spring rod 74 and a rearward keeper or catch 78 is provided on the opposite, rearward end. A forward spring 80 is positioned around spring rod 74 between forward catch 76 and carriage main body 53. Forward spring 80 is sometimes referred to as the "firing spring." Similarly, a rearward spring 82, sometimes referred to as the "retraction spring" is positioned around spring rod 74 between rearward catch 78 and the carriage main body. Forward and rearward spring 80 and 82 are spiral type springs that respectively, as detailed below, drive the blade into the open position when the knife is fired, and drive the blade into the closed position when retracted. In the preferred embodiment, the springs used to make the firing spring and the retracting spring are the same. However, the firing spring is slightly longer than the retraction spring when both springs are in the relaxed position. The purpose of this is explained below.

It will be appreciated by inspection of FIG. 5 that trough 50 is sized to accommodate the width of the catches 76 and 78, and spring rod 74 and springs 80 and 82, and that the length of spring rod 74 is somewhat less than the length of trough 50. This allows the spring rod to travel in the trough.

Figure 6:
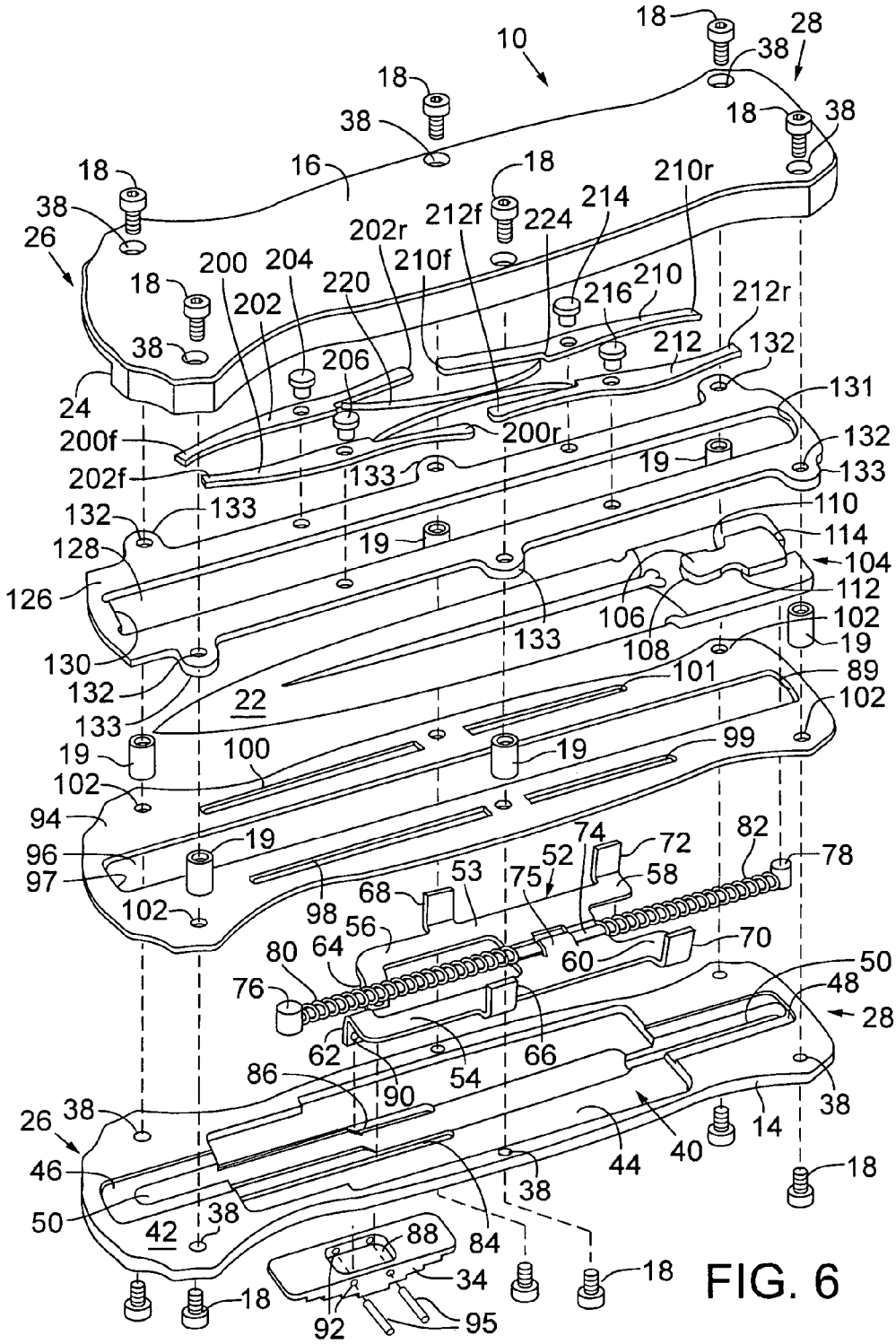
FIG. 6 is a perspective exploded view of the knife shown in FIG. 1 showing the components of the knife.

Reference is now made to the exploded view of FIG. 6. It will be appreciated that when carriage assembly 52 is received in the relatively broad portion 44 of cavity 40, tabs 62 and 64 extend through slots 84 and 86, respectively, formed in handle 14. When thumb lug 34 is assembled with knife 10, the tabs 62 and 64 extend into a cavity 88 formed in the inner-facing surface of the thumb lug. Each tab 62 and 64 has a bore drilled through it (only one bore 90 is shown on tab 64 in the perspective view of FIG. 6) that aligns with a cooperatively positioned bore 92 formed in thumb lug 34. Pins 95 are used to connect thumb lug 34 to tabs 62 and 64—the pins extend through the respective bores formed in tabs and the thumb lug. As described above and as illustrated in FIG. 6, leg 54 is slightly longer than leg 56. As a result, the tabs 62 and 64 interconnect with thumb lug 34 in an offset, forward and aft relationship. This offset connection is significantly stronger than a single tab to thumb lug connection, or a non-staggered connection.

Moving from the bottom of the page of FIG. 6 upwardly, the next component assembly is the carriage assembly 52, which was described above.

A first liner 94 is positioned over the carriage assembly 52 and retains the carriage assembly in place in cavity 40, with spring rod 74 held in trough 50. First liner 94 includes a longitudinally extending central slot 96, and lateral slots 98 and 99 on one side of central slot 96, and lateral slots and 100 and 101 on the opposite side of central slot 96. The forward end of slot 96 is closed to define a forward edge 97, and the rearward end of the slot is closed to define a rearward edge 89. In the assembled knife, tab 66 of carriage assembly 52 extends through lateral slot 98, tab 70 extends through slot 99, tab 68 extends through slot 100, and tab 72 extends through slot 101. Sleeves 19 extend through openings 102 formed through first liner 94 in positions corresponding to the positions of openings 38 in upper handle half 14 and lower handle half 16.

Figure 15:
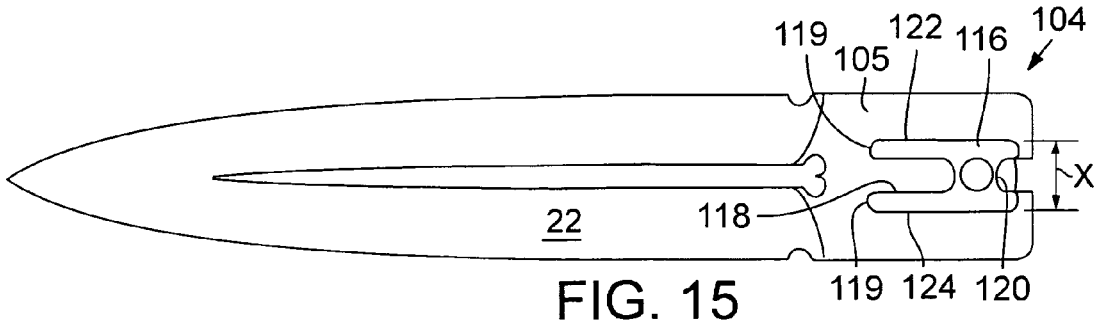
FIG. 15 is a plan view of the blade used in the knife according to the present invention, illustrating a first side of the blade.
Figure 16:
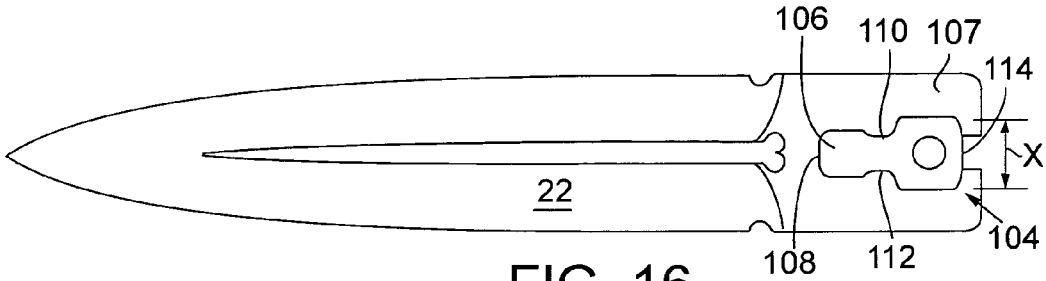
FIG. 16 is a plan view illustrating the opposite side of the blade from FIG. 15.

Continuing in the direction from the bottom of FIG. 6 toward the top, blade 22 lays adjacent first liner 94. Reference is now made to FIGS. 15 and 16, which detail the two opposed sides of blade 22. FIG. 15 illustrates the side of blade 22 referred to herein as the driving side 105.

FIG. 16 illustrates the latching side 107. As detailed herein, in the assembled knife, driving side 105 faces handle half 14 and interacts with the components of carriage assembly 52 to drive blade 22 open and closed. Latching side 107 faces handle half 16 and interacts with the firing and latching mechanisms to lock the blade in the open and closed positions. The rearward end of blade 22 is referred to generally as tang end 104. As best shown in FIG. 16, there is a first raised pad shown generally at 106 formed on tang end 104. First raised pad 106 defines a forward edge 108, a rearward edge 114, and laterally opposed notches 110 and 112 along the lateral side edges of the raised pad. The lateral side edges of raised pad 106 are parallel. As detailed below, the various portions of first raised pad 106 just described interact with the components of the firing and latching mechanisms to lock and unlock the blade 22. The width of raised pad 106 is illustrated with dimension X. Dimension X is very slightly less than the width of a central slot 128 formed in a second liner 126 that lies between blade 22 and bottom handle half 16 so the blade 22 slides easily along liner 126, but the blade is guided by the raised pad 106 as it moves along and in slot 128.

With reference to FIG. 15, the driving side 105 of blade 22 also includes a second raised pad 116 on tang end 104. Raised pad 116 is generally H-shaped and rectangular in its perimeter shape, with parallel lateral side edges. Second raised pad 116 defines a forwardly-facing and opening notch 118 in the forward portion of the pad and a rearwardly-facing and opening notch 120 in the rearward edge. The forward ends of raised pad 116 are identified with reference number 119. The width of pad 116 between opposed side edges 122 and 124 is represented by dimension X. It will be appreciated that in the assembled knife, pad 116 fits into central slot 96 of liner 94. The width of dimension X is very slightly less than the width of slot 96 so that blade 22 slides easily along liner 94, and the blade is guided by the raised pad 116 as it moves along and in slot 96. As detailed below, the components of the carriage assembly, and in particular the spring rod 74, interact with second raised pad 116 to drive the blade into the extended and closed positions.

It will be noted that the distance from the front edge 108 of raised pad 106 to the forwardmost tip of blade 22 is slightly less than the distance from the front ends 1199 of raised pad 116 to the forwardmost tip of blade 22. Said another way, the overall length of raised pad 106 measured from rear edge 114 to front edge 108 is slightly greater than the overall length of raised pad 116 measured from the rear edge to the forward ends 119. The purpose for this difference is explained below.

Although in the illustrated embodiment the widths of raised pad 106 and raised pad 116 are the same (i.e., dimension X), there is no reason why the two pads must have the same width. It will further be appreciated that first raised pad 106 has a different geometric shape and configuration from second raised pad 116—the second raised pad is generally H-shaped and the first raised pad is, in a manner of speaking, generally Y-shaped. Preferably, blade 22 is formed as an integral, monolithic piece, including the first raised pad 106 and the second raised pad 116, although they have different geometries. By forming the blade and the pads as a monolithic, unitary piece, the strength of the blade and the raised pads is increased substantially.

Returning now to FIG. 6, the next component is second liner 126. Second liner 126 includes a central slot 128 having a closed forward end that defines a forward edge 130. Similarly, the rearward end of liner 126 is closed to define a rearward edge 131. Sleeves 19 extend through openings 132 formed in appropriate locations around the periphery of second liner 126. In FIG. 6 it may be seen that openings 132 are formed in extended portions 133 formed on the second liner 126 (see e.g., FIG. 10A). These extended portions 133 fit within cooperatively shaped recesses 135 formed in handle half 16 (see FIG. 10A), thereby securing the liner relative to the handle. The diameter of sleeves 19 is greater than the diameter of openings 132. Accordingly, when the lower handle half 16 is assembled with screws 18 threaded into sleeves 19, the second liner 126 is drawn tightly against lower handle half 16, and the latching and firing mechanisms described below are captured in this combined lower handle half and attached second liner. Both first liner 94 and second liner 126 are preferably formed from a relatively hard metal because, as described below, the central slots of the liners define a guide system for ensuring linear travel of the blade.

With reference once again to FIG. 10A, a threaded opening 141 is formed through handle half 16 is the rearward end 26. A screw 142 is normally threaded into opening 141 to thereby close the opening. Opening 141 defines an access port into the interior of the handle so that the interior may be cleaned and the interior mechanisms oiled. It will be appreciated that with the OTF knife illustrated and described herein, the handle 12 entirely encloses the blade in the interior of the handle. As a result, the interior of the handle can be very difficult to clean and service with oil. In the present invention, the interior surfaces and components are radiused as much as possible to avoid sharp corners where debris might accumulate. By blowing compressed air through opening 141, debris is ejected through the blade opening at the forward end of the handle. Similarly, oil may be introduced into the handle through opening 141. This facilitates easy cleaning and oiling of the knife.

The firing and locking mechanisms will now be described. These mechanisms are defined by a group of spring loaded latch arms that are pivotally attached between lower handle half 16 (which in FIG. 6 is at the top of the page) and second liner 126. As detailed, the latch arms are activated by tabs 66, 68, 70 and 72 on carriage main body 53. The forward pair of latch arms is referred to as arms 200 and 202. As best seen in FIGS. 6 and 10A, each of the latch arms has an outwardly facing edge that is gently serpentine and S-shaped.

Each of the latch arms is mounted with a pin that has a first end residing in a cylindrical depression formed in the inner-facing side of handle half 16, extends through the latch arm and into a cooperative opening in second liner 126. With continuing reference to FIG. 6, and further with reference to FIG. 10A, latch arm 200 is pivotally mounted to in handle half 16 with pin 204, which as noted fits into a cylindrical recess formed in the inner-facing surface of handle half 16. Each of the latch arms is mounted in an identical fashion with a pin. As best seen in FIG. 6, the pins (e.g., pin 204) include a base portion that fits into the cylindrical recess in the handle, and a rod portion that extends through an opening in the latch arm and into an opening in second liner 126. Thus, latch arm 202 is pivotally mounted between handle half 16 and second liner 126 with a pin 206. The rearward pair of latch arms is identified with reference numbers 210 and 212, respectively. Arm 210 is pivotally mounted to with pin 214, and latch arm 212 is pivotally mounted with pin 216. A pair of leaf springs 220 and 222 provides spring force against the latch arms. Specifically, leaf spring 220 engages arms 200 and 210, and leaf spring 222 engages arms 202 and 212. The opposite ends of the leaf springs ride in notches 224 formed in the latch arms near the pivot points defined by the pins 200, 202, 204 and 206, respectively.

Figure 17:
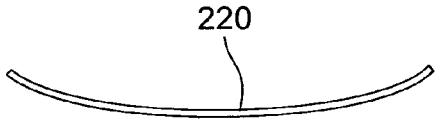
FIG. 17 is a plan view of a leaf spring used in the present invention.
Figure 18:
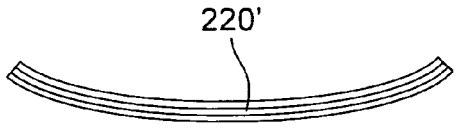
FIG. 18 is a plan view of three stacked leaf springs of the type shown in FIG. 17.
Figure 19:
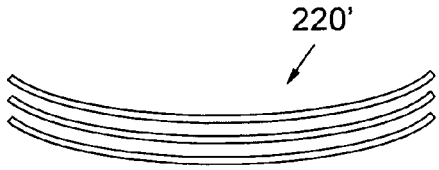
FIG. 19 is an exploded view of the three leaf springs shown in FIG. 18.

The leaf springs are held in a compressed condition in by tabs 227 formed in handle half 16. From FIG. 10A it will be appreciated that when the leaf springs are assembled in the handle half 16, the springs apply outwardly-directed pressure to the latch arms. With respect to arms 200 and 202, the leaf springs exert pressure against the arms rearwardly of the pivot points defined by pins 204 and 206. With respect to arms 210 and 212, the leaf springs exert pressure against the arms forward of the pivot points defined by pins 214 and 216. The respective forward and rearward ends of the latch arms are identified with the number of the latch arm, and the letter "f" to denote forward, and the letter "r" to denote rearward. Thus, the forward end of arm 200 is labeled **200*f*. The rearward end of arm 200 is labeled 200*r*. The forward end of arm 210 is labeled 210*r*, and the rearward end is 210*f*, and so on. Leaf spring 222 operates on latch arms 202 and 212. The forward end of spring 220 rides in notch 224 of arm 202, and the rearward end of the spring rides in notch 224 of arm 212. The biasing force of spring 220 normally urges forward end 202*f* of arm 202 inwardly (toward the longitudinal midline of handle half 16), and likewise urges the rearward end 202*r* of arm 202 inwardly. Leaf spring 220 operates in an identical manner on latch arms 200 and 210, at all times urging forward end 200*f* and rearward end 210*r* inwardly. The relative force applied by leaf springs 220 and 222 may be adjusted by varying the strength of the material used to form the spring. A single leaf spring 220 is illustrated in FIG. 17. It will be appreciated that a stronger spring force may be accomplished by "stacking" plural leaf springs, as shown in FIG. 18, which illustrates three stacked leaf springs 220'. FIG. 19 illustrates the three stacked leaf springs 220'** separated from one another. There are other equivalent methods of varying the spring force applied by the leaf springs, for example by judicious selection of materials used to make the spring.

With specific reference to FIG. 10A, the lateral interior sides of the bottom handle half 16 are contoured adjacent to where ends **200*r*, 202*r* and 210*f* and 212*f* approach the handle to generally conform to the serpentine S-shape of the corresponding outward-facing portions of the latch arms. As the latch arms pivot about the pivot points defined by the mounting pins, the forward and rearward ends of the latch arms either move toward, or away from, the interior midline of the handle, depending upon which direction the thumb lug 34 is being moved and activated by the tabs 66, 68, 70 and 72. It may be seen in FIG. 10A that the tabs just mentioned reside and travel longitudinally in widened portions of handle half 16 identified with reference number 140, outwardly of and adjacent to the latch arms. As detailed below, as the thumb lug 34 is moved forward and aft, the tabs 66 through 72** move forward and aft and act on the respective latch arms.

Returning to FIG. 6, the final component of knife 10 is bottom handle half 16. It will be appreciated that when all of the components shown in FIG. 6 are assembled, the interior components are held between the two interconnected handle halves and the blade is longitudinally slidable in the handle between open and closed positions.

Having described the structural components of knife 10, the operation of the knife will now be described in detail with reference to operation of the locking and firing mechanisms.

Figure 7:
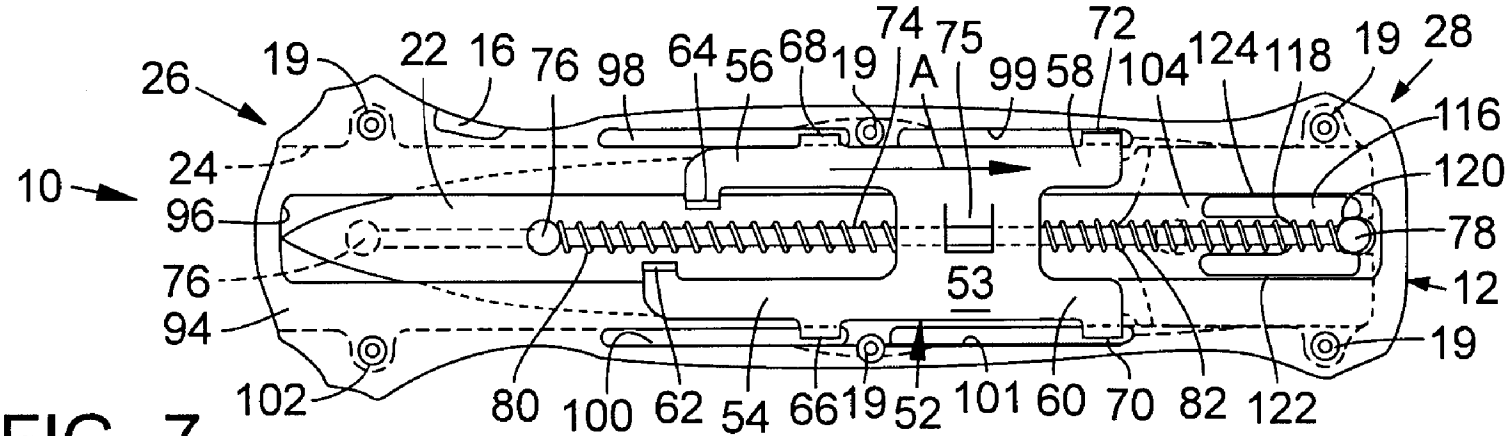
FIGS. 7 through 10 are a series of plan views of the knife according to the present invention looking at the interior of the assembled. The series of drawings in FIGS. 7 through 10 illustrate the carriage assembly and associated internal components of the knife as it is being opened and closed.
Figure 8:
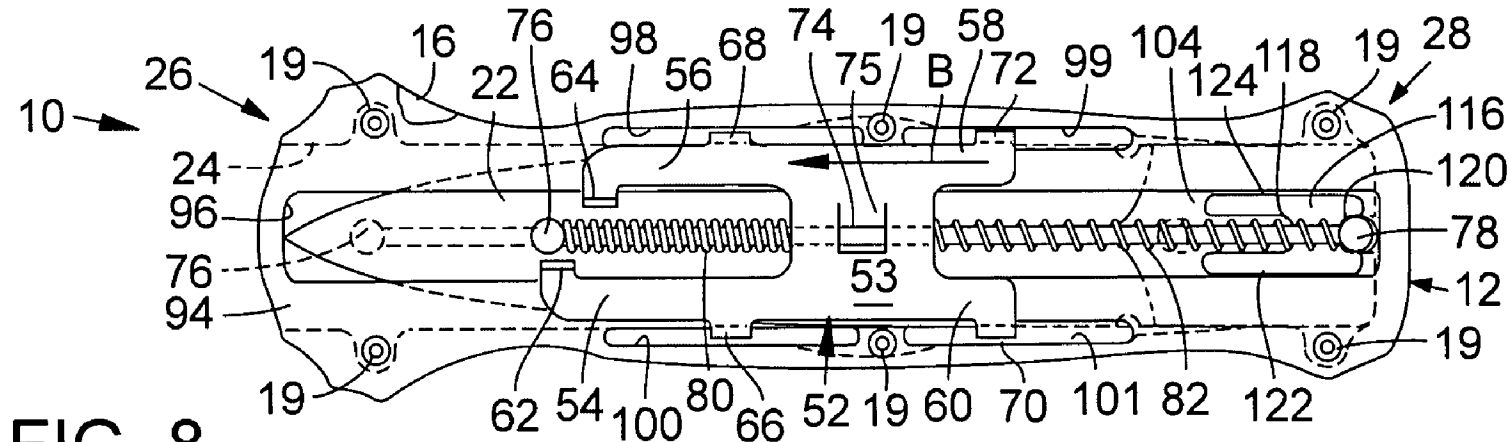
Figure 9:
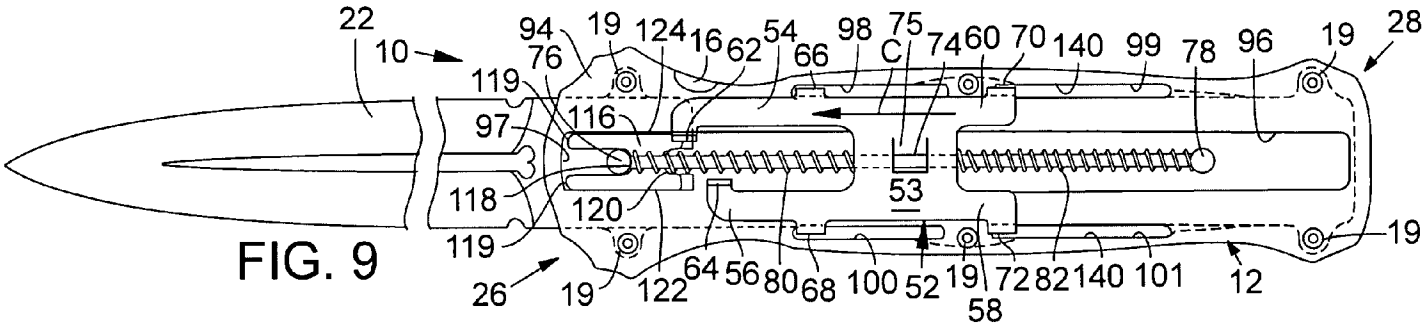
Figure 10:
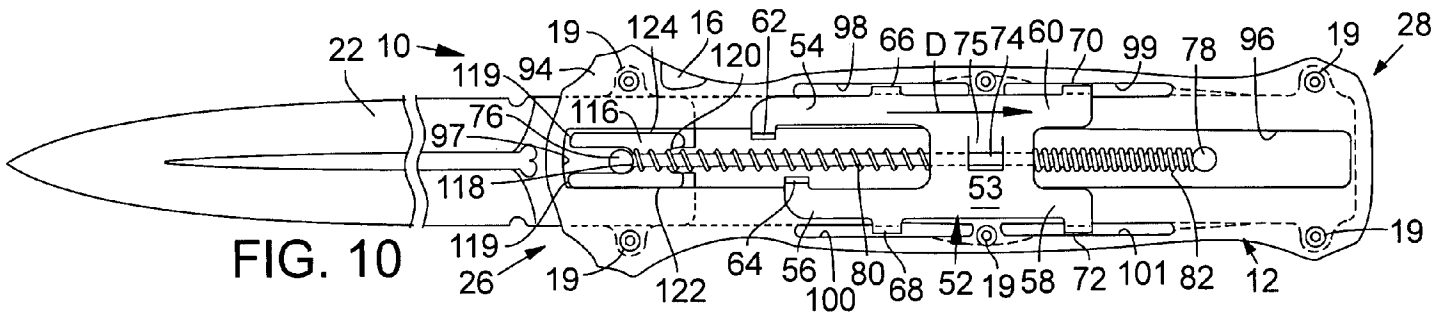
Figure 11:
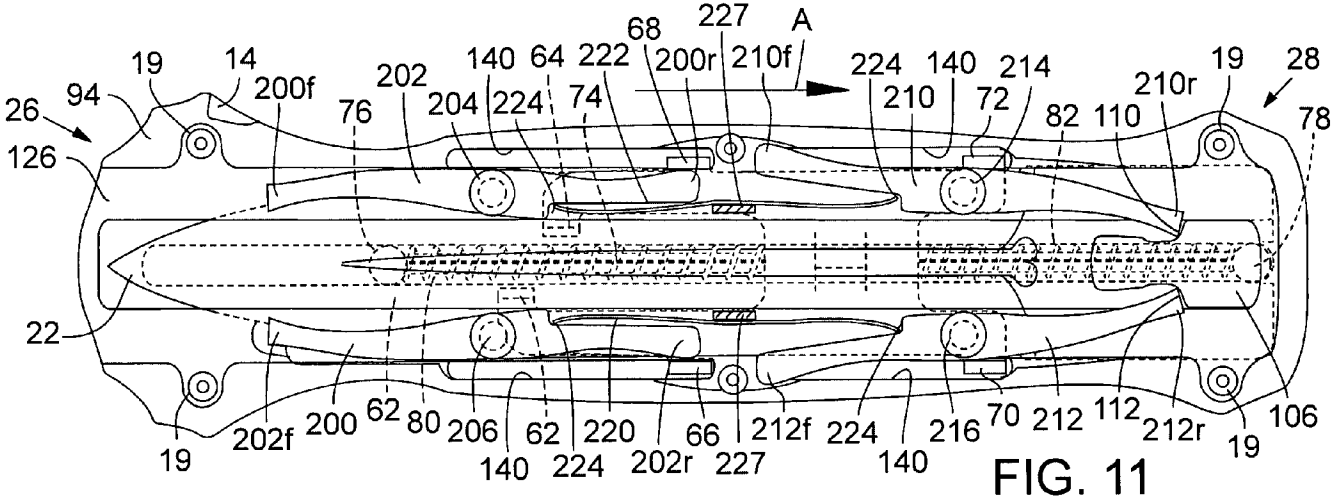
FIGS. 11 through 14 are a series of plan views of the knife shown in FIGS. 7 through 10, except in FIGS. 11 through 14 the illustrations show the operation of the firing and locking mechanisms as the knife is opened and closed.
Figure 12:
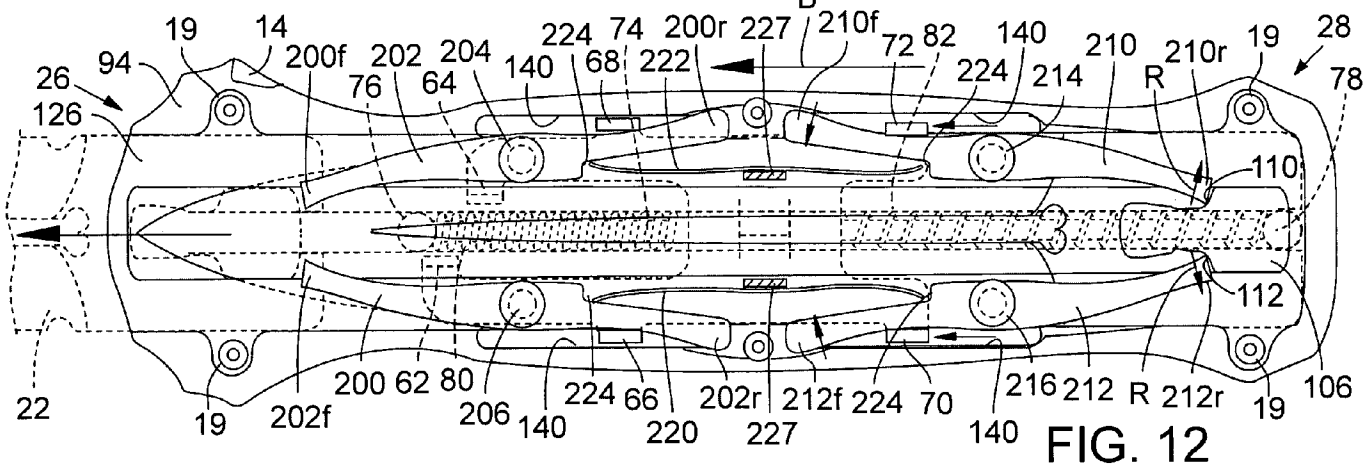
Figure 13:
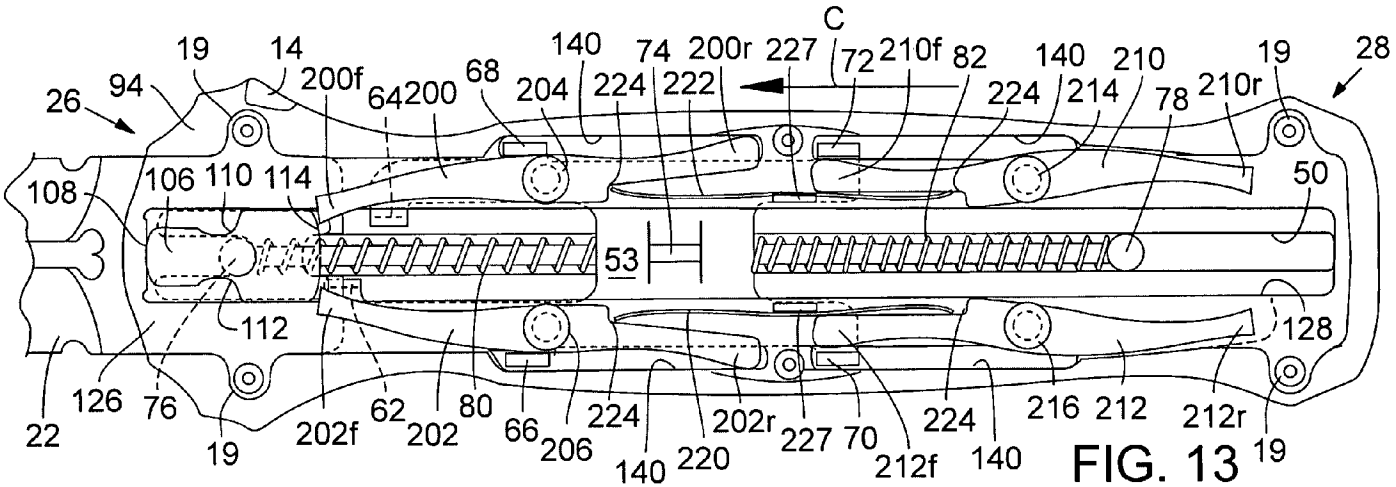

Reference is made to the series of FIGS. 7 through 10, and the corresponding series of FIGS. 11 through 13. FIGS. 7 through 10 show the carriage assembly and associated components and the view is from the interior looking toward lower handle half 16. In FIGS. 11 through 14, the view is from the interior looking toward upper handle half 14. FIGS. 11 through 16 detail the firing and latching mechanisms. FIGS. 7 through 10 and the description of them correspond to FIGS. 11 through 14 and the corresponding description. Thus, FIGS. 7 and 11 show the knife with the blade in the same position, except they show different mechanisms within the knife. FIG. 8 corresponds to FIG. 12 in the same manner, FIG. 9 corresponds to FIG. 13, and so on.

Beginning with FIG. 7 and the corresponding FIG. 11, the knife 10 is shown with blade 22 in the closed position with the blade locked. When the blade 22 is in the closed and locked position, thumb lug 34 is slid toward the rearward most point in groove 36, shown schematically with arrow A. As shown in FIG. 7, catch 78 on the rearward end of spring rod 74 is engaged with notch 120 of raised pad 116. In this position, the forward or firing spring 80 is very slightly compressed between the main body 53 and forward catch 76. The rearward or retraction spring 82 is similarly slightly compressed between main body 53 and rearward catch 78. Turning to FIG. 11, as noted earlier, leaf springs 220 and 222 are pressing against the activation arms, urging the forward ends of 200*f* and 202*f* inwardly, and the rearward ends 210*r* and 212*r* inwardly. As noted, tabs 66, 68, 70 and 72 reside in widened portions 140 of handle half 16. Tabs 70 and 72 are in a "neutral" position, rearward of the pivot point for arms 210 and 212 defined by pins 214 and 216, respectively. In this context, "neutral" means the tabs are not exerting any pressure and the activation arms and the arms are under the influence of the leaf springs. Tabs 66 and 68 are, however, acting on arms 202 and 200, respectively. Thus, as seen in FIG. 11, the tabs 66 and 68 are in contact with the respective activation arms rearward of the pivot points defined by pins 206 and 204, causing forward ends 200*f* and 202*f* to be moved outwardly toward the respective lateral sides of knife 10, and against the force of leaf springs 220 and 222, which constantly urge forward ends 200*f* and 202*f* inwardly. Under the biasing force applied by leaf springs 220 and 222, the rearward end 21 Or of activation arm 210 is pressed into notch 110 of raised pad 106 on tang portion 104. Likewise, rearward end 212*r* of activation arm 212 is pressed into notch 112 of raised pad 106. Because forward spring 80 is slightly compressed and catch 78 is engaging notch 120 on raised pad 116, the blade is being urged by slight spring force in the forward direction. This holds the rearward ends 210*r* and 212*r* securely in notches 110 and 112, respectively, securely locking the blade 22 in the closed position and preventing it from moving until the blade is actively released.

Moving next to FIGS. 8 and 12, thumb lug 34 is moved in the forward direction shown with arrow B. As the thumb lug moves in groove 36, main body 53 of carriage assembly 52 slides forward, while spring rod 74 remains stationary, causing firing spring 80 to be compressed between main body 53 and forward catch 76. This loads firing spring 80 with significant spring force; as noted previously, firing spring 80 is slightly longer than retraction spring 82. Simultaneously, as main body 53 slides forwardly, tabs 66, 68, 70 and 72 move correspondingly forward. With reference to FIG. 12, as tabs 66 and 68 move in the forward direction the tabs stop exerting pressure on arms 202 and 200, and under the biasing force of leaf springs 220 and 222, forward ends 200*f* and 202*f* again move inwardly. At the same time, tabs 70 and 72 are moved in front of the pivot points defined by pins 214 and 216, and as this happens, the tabs exert inwardly-directed pressure on the forward portions of arms 210 and 212, causing rearward ends 210*r* and 212*r* move outwardly in the direction of arrows R under the force applied to arms 210 and 212 by springs 220 and 222. Once the rearward ends 210*r* and 212*r* have moved simultaneously out of notches 110 and 112 and have thus cleared raised pad 116, the blade 22 is unlocked and released, resulting in the blade being driven forward rapidly under the spring force applied to the blade by firing spring 80, which is acting on the blade by virtue of rearward catch 78 engaging notch 120 on raised pad 116. At this point the blade travels longitudinally forward rapidly. Because dimensions X of raised pads 106 and 116 are in close tolerance to the widths of the central slots 128 in liner 126, and 96 in liner 94, in which the raised pads ride, and because the dual latch arms 210 and 212 release their locking engagement with the raised pad 116 simultaneously, the blade is driven highly linearly with little variance or wobble.

Reference is now made to FIG. 9 and corresponding FIG. 13. The forward travel of blade 22 (arrow C) is stopped when the forward edge 108 of raised pad 106 hits the forward closed end 130 of central slot 128—the closed end acts as a blade stop. As noted earlier, the length of raised pad 116 is slightly less than the length of raised pad 106. Accordingly, forward ends 119 of raised pad 116 do not contact the closed end 97 of first liner 94. Spring rod 74 moves in the forward direction as forward catch 76 engages notch 118 of raised pad 116. A short distance before the forward travel of blade 22 stops, retraction spring 82 compresses slightly between main body 53 of carriage assembly 52 and rearward catch 78. This slight compression of the retraction spring functions to cushion the impact of blade 22 when it stops its forward travel.

Simultaneously, and with reference to FIG. 13, tabs 66 and 68 have moved forward of the pivot points defined by pins 206 and 204. As a result, forward ends 200*f* and 202*f* are urged inwardly under the force applied to arms 200 and 202 by leaf springs 220 and 222. Once the rearward edge 114 of raised pad 106 is in front of the forward ends 200*f* and 202*f*, those ends move inwardly, engaging the rearward edge 114 and securely locking the blade 22 in the forward position. In the preferred embodiment, retraction spring 82 is slightly compressed when the blade is in this position, which results in a slight force urging the blade 22 inwardly (by virtue of the engagement between forward catch 76 and notch 118). Tabs 66 and 68 are now in a neutral position. However, tabs 70 and 72 are now pressed against arms 210 and 212 near the respective forward ends of those arms (210*f* and 212*f*), causing the rear ends of those arms (210*r* and 212*r*) to be positioned outwardly as shown in FIG. 13.

Figure 10A:
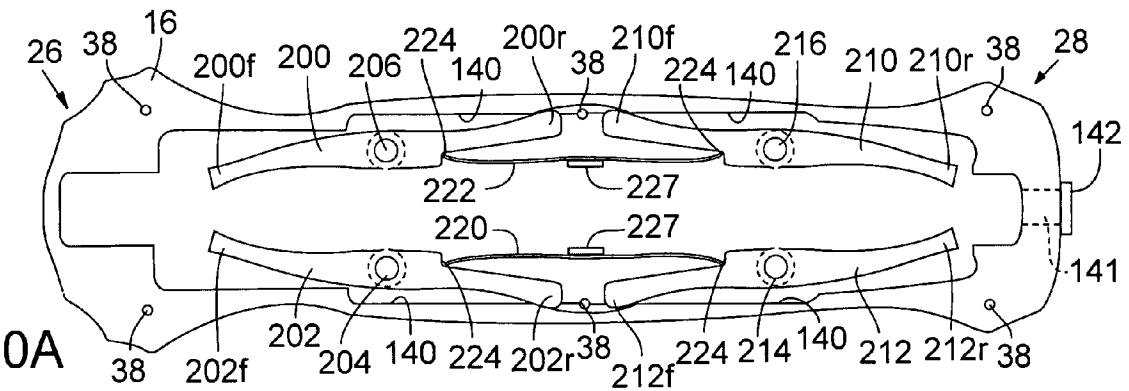
FIG. 10A is a plan view of the lower handle half showing the interior side of the handle half and some components of the firing and latching mechanisms.
Figure 14:
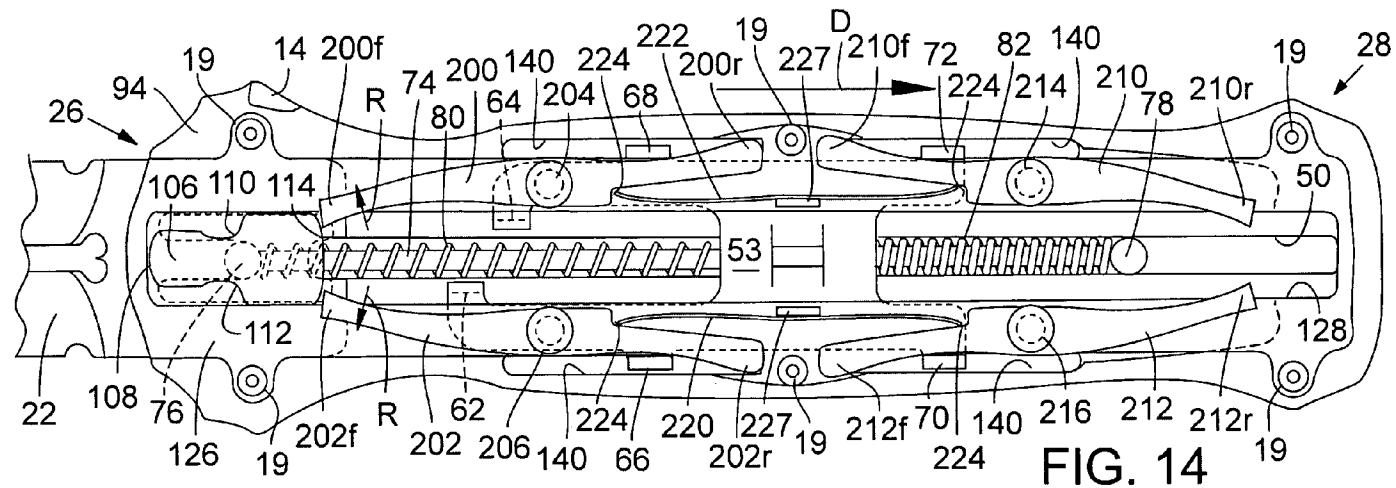

Automatic retraction of blade 22 from the open and locked position to the closed and locked position is detailed in the paired images of FIGS. 10 and 14. Beginning with FIG. 10, when blade 22 is in the open locked position, both retraction spring 82 and firing spring 80 are slightly compressed. Forward catch 76 on spring rod 74 is engaged with notch 118, and as detailed above, the forward ends 200*f* and 202*f* of arms 200 and 202 are wedged behind rearward edge 114 of raised pad 106. As thumb lug 32 is moved rearwardly, represented by arrow D, main body 53 of carriage assembly 52 slides along spring rod 74, causing significant compression of retraction spring 82 between rearward catch 78 and main body 53. At this point, spring rod 74 is held stationary by virtue of the engagement between the rod and the blade. With reference to FIG. 14, as thumb lug 32 is moved rearwardly (arrow D), tabs 66 and 68 slide rearwardly past the pivot points defined by pins 204 and 206. Once these tabs reach a point behind the pivot points, the tabs exert inwardly-directed pressure against the arms rearward of the pivot points, causing the forward ends 200*f* and 202*f* move outwardly (arrows R) against the biasing force applied to arms 200 and 202 by leaf springs 220 and 222, releasing the locking engagement between the arms 200 and 202 and the rearward edge 114 of raised pad 106. Tabs 70 and 72 are at the same time moved to the neutral position, so that tearward ends 210*r* and 212*r* are urged inwardly by the leaf springs, ready to once again lock blade 22 in the closed position once blade 22 is driven rearwardly to the point where the rearward ends 210*r* and 212*r* engage notches 110 and 112. Because retraction spring 82 is highly compressed, once the forward ends 200*f* and 202*f* release the blade, the blade retracts rapidly into handle 12 until it is locked in the closed position, as described above with reference to FIGS. 7 and 11.

Based upon the foregoing description of the structure and operation of the knife of the present invention, it will be appreciated that the firing and latching mechanisms according to the present invention define an OTF knife that is automatically opened and closed under spring force, with a single trigger mechanism that operates to both open and closed the knife. The knife incorporates a latch mechanism to open the blade, a latch to close the blade, separate springs to propel the blade from closed to open, and open to closed, and a timing mechanism defined by the carriage assembly to time precisely when the blade is driven from closed to open, and from open to closed.

It will be readily appreciated that the OTF knife described above defines a structure that allows the blade to be very securely locked in the open position, overcoming one of the major drawbacks of other OTF knives. In particular, with the present invention the blade is locked open with a three-point, triangulated locking system. Thus, when blade 22 is locked open, the forward edge 108 of the raised pad 106 abuts the closed forward edge 130 of central slot 128 of liner 126; this is the first point of connection, or "land." The second and third lands are provided by the forward ends 200*f* and 202*f* of the activation arms, which engage independent surfaces of the rearward edge 114 of raised pad 106. This triangulation system with the three lands between the handle and the blade results in an OTF knife having an extremely strong blade lock, in which the blade does not wobble relative to the handle. In one preferred and illustrated embodiment, the forward edge 108 of raised pad 106 may be formed with a slight radius, and the corresponding forward edge 130 of central slot 128 of the liner may likewise be formed with a slight radius that may be different from the radius of forward edge 108. When this structure is used, the blade will settle into a secure locking position when the forward ends 200*f* and 202*f* engage the rearward end 114. Likewise, the forward ends 200*f* and 202*f* may be cooperatively shaped with the engaging surfaces on rearward edge 114 so that the arms closely engage the rearward edge. Because the activation arms are separately sprung, the forward ends independently seek the best abutting relationship with the blade 22. The same applies to the configuration of rearward ends 210*r* and 212*r* and notches 110 and 112. Moreover, the dual latch arms ensure a symmetric launch of the blade, which also contributes to linear travel. This applies to firing the blade from closed to open, and from open to closed.

The carriage assembly 52 and the tabs 66, 68, 70 and 72 cooperate with the latch arms to define a timing function. That is to say, the positions of the tabs relative to the position of the latch arms and the compression status of the firing and retraction springs can effect when the blade fires open, and closed. For example, changing the position of tabs 66 and 68 either forward or aft on carriage main body 53 will alter the time at which the blade is fired closed when thumb lug 34 is moved rearwardly. Likewise, altering the position of tabs 70 and 72 in either the forward or aft direction will on main body 53 will change the time at which the blade is fired open as trigger 34 moves forward. It will be appreciated therefore that the timing of blade firing in both directions is readily adjustable by changing the relative positions of these tabs on the carriage main body. Preferably, when the blade is fired from closed to open, the timing—that is, the positions of the tabs relative to the compression status of firing spring 80, is such that firing spring 80 is substantially compressed at the point in time when tabs 70 and 72 cause arms 210 and 212 to release the blade. Thus, sequentially the firing spring 80 is compressed prior to the tabs causing the activation arms to release. Since firing spring 80 is substantially compressed, when the arms release the blade it is driven forward rapidly. Likewise, when the blade is fired from open to closed, the retraction spring 82 is preferably substantially compressed prior to when the tabs 66 and 68 cause arms 200 and 202 to release the blade. Compression of the retraction spring 82 sequentially before release of the blade results in the blade being fired toward closed with sufficient force for the blade to be locked closed.

As noted above, second liner 126 is securely held in position in handle half 16 by virtue of the extended portions where openings 132 are formed, which fit into recesses 133 formed in the handle. Even though blade 22 is propelled with significant force from closed to open, when the travel of the blade stops when forward edge 108 hits edge 130, the liner does not move relative to the handle. Because the latch arms and accompanying components are positioned to one side of the plane defined by blade 22, and because the forward edge 108 of raised pad 106 hits the blade stop defined by edge 130 but the forward ends 119 of raised pad 116 do not contact the edge 97, when blade 22 is locked open, the blade is very slightly cocked or canted as a result of the pressure applied to the blades by the latch arms. This canting prevents the blade from wobbling. Thus, the latch arms necessarily apply biasing force against the blade in a direction generally transverse to the plane of the blade. This biasing force further strengthens the interconnection between handle and blade.

The dual locking arms that lock the blade open, and the dual lock arms that lock the blade closed ensure linear and symmetric travel of the blade in both opening and closing directions. Linear travel of the blade is also ensured by the close tolerance fit between the central slots 96 and 128 of liners 94 and 126, respectively, and the lateral edges of raised pads 106 and 116. Furthermore, the close tolerance between the lateral edges of the raised pads and the sides of the central slots helps in preventing blade wobble in the direction generally defined by the flat plane of the blade.

It will be appreciated that various substitutions and modifications may be made without departing from the scope of the invention defined in the claims. For example, the strength of the firing spring 80 and the retraction spring 82 may be varied relative to one another in order to alter the strength and speed with which the blade 22 is propelled to the open position, and the strength and speed with which the blade is propelled to the closed position. As noted, because the firing spring 80 is in the preferred embodiment slightly longer than the retraction spring 82, the blade fires from the closed position into the open position with greater force than the knife fires from the open to the closed position. This is because with the relatively longer firing spring 80 is under more compression than would result from a relatively shorter spring, as is used with retraction spring 82.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. An OTF knife, comprising:

a handle comprising a first handle side wall and a second handle side wall, a front end and a back end, said first and second handle side walls defining a blade-receiving space and an opening into the space through the front end;

a blade longitudinally slidable in the handle between a closed position in which the blade is received in the handle and an open position in which said blade extends through said opening, said blade having a working portion and a tang portion and when said blade is in the open position said tang portion remains substantially within the handle;

a first liner between one side of the blade and the handle, and a second liner between the opposite side of the blade and the handle, each of said liners having a longitudinally aligned central slot with a closed forward end;

a spring configured for moving the blade from the closed to the open position;

a blade stop for stopping movement of the blade in the open position;

a blade lock defined by a first latch arm operable to engage the blade when in the open position, and a second latch arm operable to engage the blade when in the open position.

2. The OTF knife according to claim 1 wherein said tang portion includes a first raised portion on a first side thereof, the first raised portion having a front edge and a rear edge, and wherein the first raised portion is received in the central slot of the first liner.

3. The OTF knife according to claim 2 wherein the blade stop further comprises the closed forward end of said first liner and wherein in said open position said front edge of said first raised portion abuts said closed forward end.

4. The OTF knife according to claim 3 wherein said first latch arm engages the rear edge of said first raised portion and said second latch arm engages the rear edge of said first raised portion to lock said blade in the open position.

5. The OTF knife according to claim 2 wherein said tang portion further includes a second raised portion on a second side thereof, and wherein the second raised portion is received in the central slot of the second liner.

6. The OTF knife according to claim 5 wherein the second raised portion has a different geometric configuration from said first raised portion.

7. The OTF knife according to claim 6 wherein said blade is monolithic.

8. An OTF knife, comprising:

an elongate handle having an opening in a front end and a blade-receiving space within the handle;

a blade having a working portion and a tang portion, the blade slidable in the handle between a closed position in which the blade is within the handle and an open position in which the working portion extends outwardly of the handle and the tang portion is substantially within the handle, the tang portion further including a first pad on one side of the tang portion and a second pad on the other side of the tang portion, the first pad having a different geometric configuration from the second pad;

a lock for locking the blade in the open position.

9. The OTF knife according to claim 8 including a lock for locking the blade in the closed position.

10. The OTF knife according to claim 9 including a trigger slidable in a first direction when said blade is in the locked closed position to sequentially compress a first spring and then unlock the blade to thereby drive the blade from the closed position to the open position.

11. The OTF knife according to claim 10 wherein said trigger is slidable in a second direction when said blade is in the locked open position to sequentially compress a second spring and then unlock to blade to thereby drive the blade from the open position to the closed position.

12. The OTF knife according to claim 8 wherein the blade is monolithic.

13. The OTF knife according to claim 12 wherein the lock further comprises first and second latch arms that engage the tang portion to lock the blade in the open position.

14. The OTF knife according to claim 8 including an access port in said handle.

15. An OTF knife, comprising:

a handle comprising a first handle side wall and a second handle side wall, a front end and a back end, said first and second handle side walls defining a blade-receiving space and an opening into the space through the front end;

a blade longitudinally slidable in the handle between a closed position and an open position, said blade having a working portion and a tang portion;

a first raised pad on one side of the tang portion, said first pad having a front edge and parallel side edges:

a second raised pad on an opposite side of the tang portion from the first raised pad, the second raised pad having parallel side edges;

a first liner between the blade and the first handle side wall, said first liner having a central slot into which said first raised pad is received;

a second liner between the blade and the second handle side wall, said second liner having a central slot into which said second raised pad is received;

wherein said central slots in said first and second liners guide said blade as it slides longitudinally in said handle.

16. The OTF knife according to claim 15 including a first lock for locking the blade in the open position and a second lock for locking the blade in the closed position.

17. The OTF knife according to claim 16 including a trigger operable when said blade is in the locked closed position to sequentially compress a first spring and then unlock the blade to thereby drive the blade from the closed position to the open position.

18. The OTF knife according to claim 17 wherein said trigger is operable when said blade is in the locked open position to sequentially compress a second spring and then unlock the blade to thereby drive the blade from the open position to the closed position.

19. The OTF knife according to claim 15 including a selectively openable and closable port in the handle.

* * * * *